United States Patent [19]

Cunningham et al.

[11] Patent Number: 5,054,257

[45] Date of Patent: Oct. 8, 1991

[54] CUT-OFF DEVICE FOR CAN-CONTAINER PACKAGING EQUIPMENT

[75] Inventors: Ernest R. Cunningham, Libertyville, Ill.; Merlin Miller, Bradford, Ohio

[73] Assignee: Grip-Pak, Inc., Libertyville, Ill.

[21] Appl. No.: 386,285

[22] Filed: Jul. 27, 1989

[51] Int. Cl.[5] ..... B65B 21/00

[52] U.S. Cl. ..... 53/48.4; 83/326

[58] Field of Search ..... 53/48, 398, 48.4; 83/326, 614

[56] References Cited

U.S. PATENT DOCUMENTS

| | | | |
|---|---|---|---|
| 3,032,943 | 5/1962 | Reimers et al. . | |
| 3,032,944 | 5/1962 | Hull et al. . | |
| 3,204,386 | 9/1965 | Creed et al. . | |
| 3,328,937 | 7/1967 | Newman et al. | 53/282 |
| 3,383,828 | 5/1968 | Cunningham . | |
| 3,475,878 | 11/1969 | West, Jr. | 83/326 X |
| 3,507,429 | 4/1970 | Cunningham . | |
| 3,782,070 | 1/1974 | Erlandson | 83/326 X |
| 3,851,445 | 12/1974 | Schuh | 83/326 X |
| 3,991,640 | 11/1976 | Schlueter | 53/48 X |
| 4,294,143 | 10/1981 | Lieberman | 83/326 X |
| 4,817,361 | 4/1989 | Cunningham | 53/48 |

OTHER PUBLICATIONS

Model 250 Series Hi-Cone Applicating Machine.
Model 260 Series Hi-Cone Applicating Machine.
Model 270 Series Hi-Cone Applicating Machine.
Model 500 Hi-Cone Applicating Machine.

*Primary Examiner*—John Sipos
*Attorney, Agent, or Firm*—McAndrews, Held & Malloy, Ltd.

[57] ABSTRACT

A strip cutoff assembly for successively partitioning an array of can-type containers connected by a continuous plastic strip as the array travels along a conveyor at a constant rate. The strip cutoff assembly includes a pair of endless chains carrying a cutting device in an orbit about a series of axles for periodically dividing the array into units of a predetermined length. An alignment device connected to the cutting device contacts the containers so as to evenly space the containers as the cutting device traverses the plastic strip.

2 Claims, 7 Drawing Sheets

CUT-OFF DEVICE FOR CAN-CONTAINER PACKAGING EQUIPMENT

BACKGROUND OF THE INVENTION

The invention relates to a cutting device for container packaging equipment which automatically cuts a plastic strip which serves as a carrier for packaging together a plurality of cans, and more particularly relates to a cutting device which is variable to permit partitioning of connected cans into packages of four, six, eight, or multiples thereof.

Plastic strip carriers which elastically receive the tops of beer and soft-drink cans are used for packaging the cans into four packs, six packs, eight packs or the like. In packaging equipment, the plastic strip is applied to the tops of the can containers as the containers move along a conveyor. The strip holding the containers must be severed to provide identical multipacks of cans.

In some cases, the plastic strip is perforated so that the packages may be separated from the continuous array of connected cans. In other cases, the strip is cut by a pair of blades which are mechanically driven from the outer sides of the cans toward the central area of the strip. See U.S. Pat. Nos. 3,383,828 and 3,204,386.

High production quotas in the refreshment industry have necessitated the continual movement of the containers through the packaging stage of the production process. Therefore, it is highly desirable to speed up the packaging procedure as much as possible.

It is therefore an object of the present invention to provide an apparatus which automatically partitions a continuously moving array of paired connected cans into separate discrete units.

It is yet another object of the present invention, to provide a strip cutoff assembly which cooperates with a moving conveyor to partition an array of paired connected cans moving along the conveyor.

SUMMARY OF THE INVENTION

These and other objects of the invention are achieved in a strip cutoff assembly which divides a continuous array of moving cans which are retained by a plastic strip as the array travels rapidly along a conveyor. The strip cutoff assembly includes a cutting blade orbitally driven around a series of axles at a rate that is directly proportional to the rate of progression of the conveyor. The blade periodically traverses the can array at uniform intervals in order to cut the plastic strip, producing carrier units of a predetermined number of cans. In the preferred embodiment, the orbital period of the cutting blade may be adjusted so as to increase or decrease the number of cans divided into discrete portable units.

DESCRIPTION OF THE PREFERRED EMBODIMENT

Figure 1:
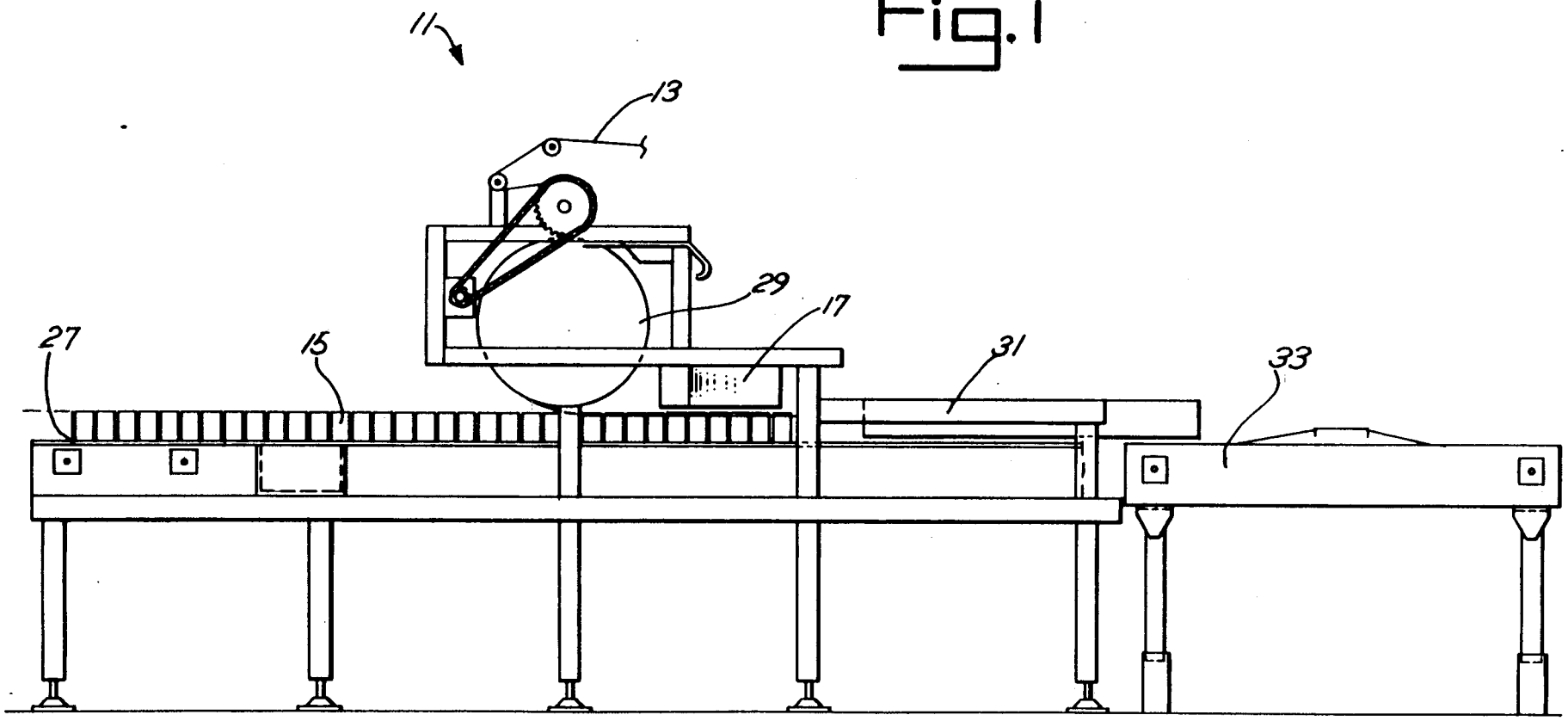
FIG. 1 is a side view of can packaging equipment having an embodiment of the strip cutoff assembly of the present invention.
Figure 2:
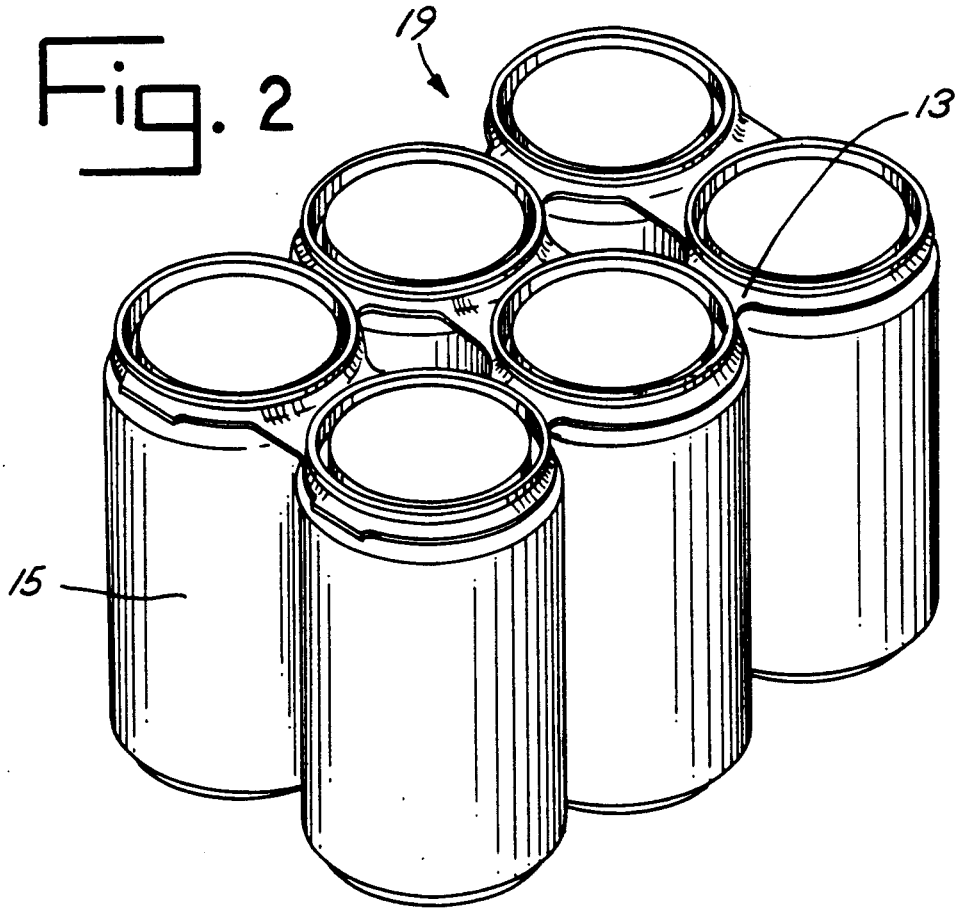
FIG. 2 is a perspective view of six cans packaged by the packaging equipment of FIG. 1.

Referring to FIGS. 1 and 2, can-container packaging equipment 11 applies a continuous plastic strip !3 onto the tops of a plurality of cylindrical containers or cans 15 such as twelve ounce beer or soft drink cans. A strip cutoff assembly 17 cuts the plastic strip 13 after it has been applied to the cans for partitioning the plurality of containers 15 into portable units, as for example, a six pack 19 as shown in FIG. 2. The strip cutoff assembly 17 is alterable in order to vary the number of cans which are cut into portable units or packages similar to six pack 19.

Figure 3:
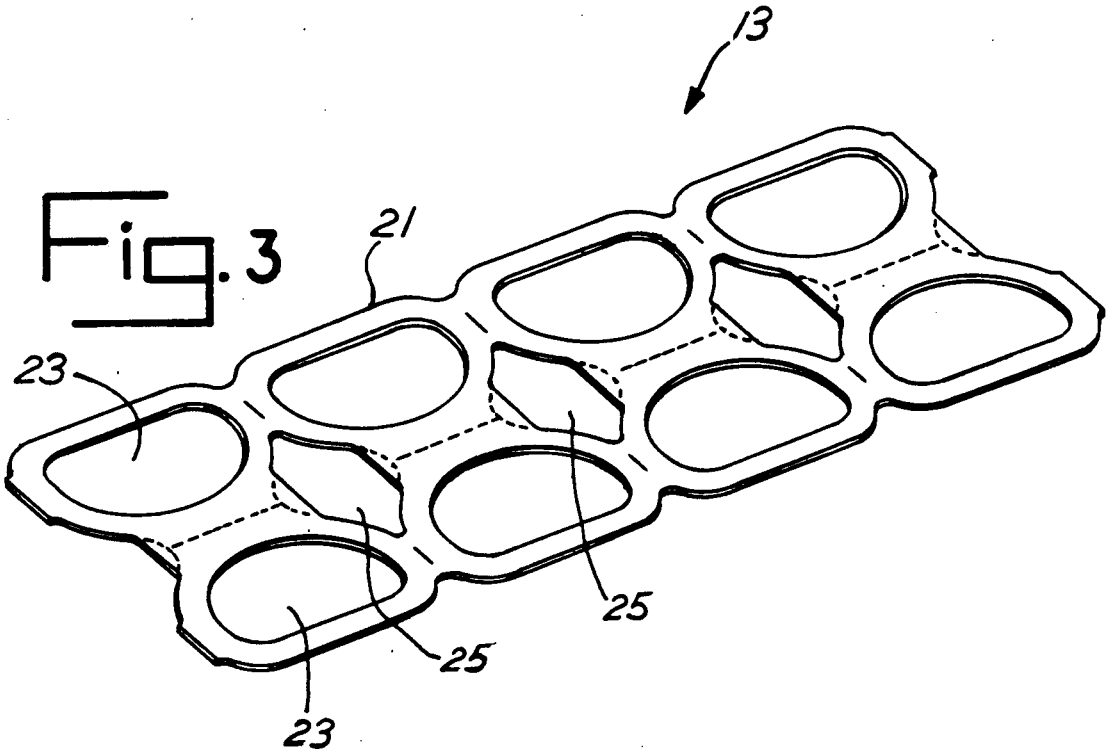
FIG. 3 is a top view of a plastic strip which is applied to the cans by the packaging equipment of FIG. 1.

As shown in FIG. 3, the plastic strip 13 comprises an elongated piece of plastic 21 having two rows of generally semicircular apertures 23 formed along opposite side edges of the plastic strip. The apertures 23 form opposing pairs across the width of the plastic strip to retain the cans in a side-by-side relationship. Each aperture 23 is elastically expandable for receiving the upper portion of a can and retaining it to the plastic strip. Fingerholes 25 are formed in the plastic strip between the adjacent pairs of apertures to permit easy grasping of the portable units. As understood, cans connected by plastic strip 13 will be retained in a continuum of two rows which is cut by the strip cutoff assembly 17 into a rank of two three, four, five cans, etc.

Figure 4:
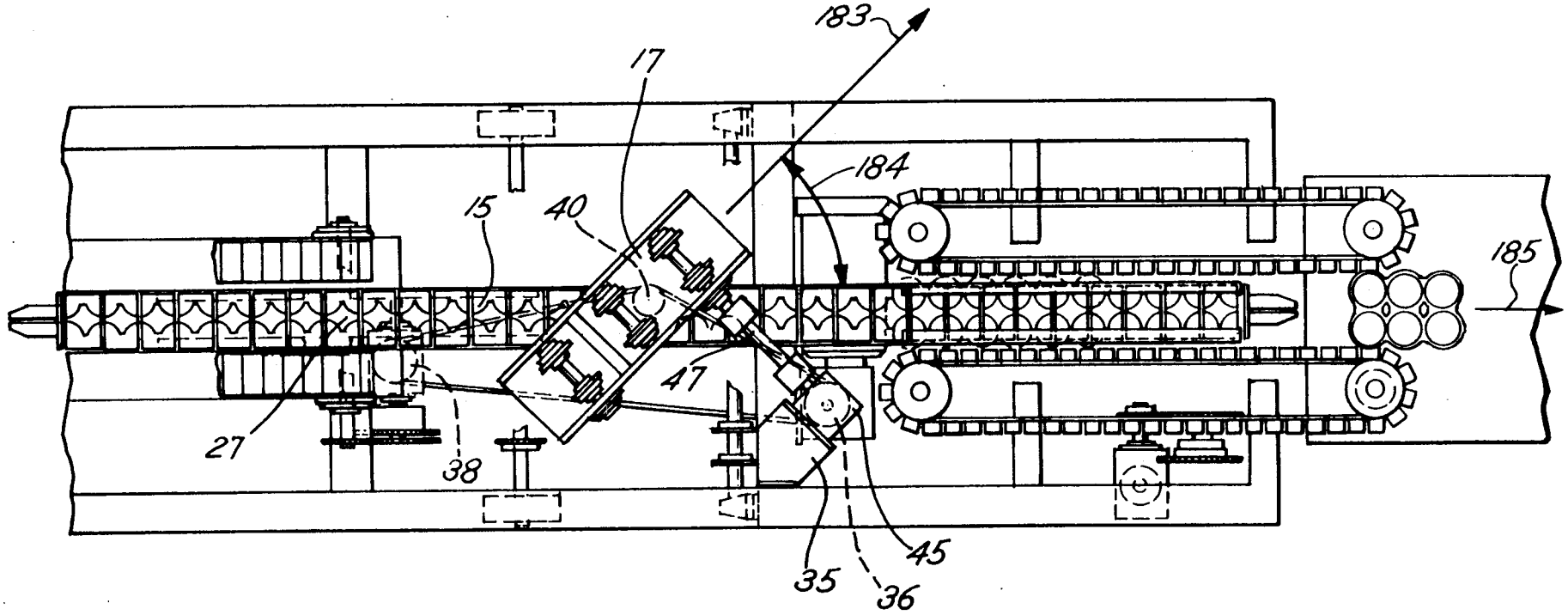
FIG. 4 is a top view of a portion of the packaging equipment of FIG. 1.

Referring again to FIG. 1, a conveyor 27 transports a plurality of cans 15 which merge into two rows and pass under a strip application roller 29 which is described in U.S. Pat. No. 4,817,361, assigned to the same entity as the present invention. Strip application roller 29 applies plastic strip !3 onto the moving cans thereby connecting the cans in a continuous arrangement. The connected continuum of cans progresses along conveyor 27 passing beneath strip cutoff assembly 17 which partitions the continuum into portable units of a predetermined number of cans. Following partitioning of the continuum, the portable units are engaged by an outfeed gripper 31 which guides the units into an outfeed diverter 33. As shown in FIG. 4, conveyor 27 transports the cans in pairs in side-by-side relationship along a linear path 185. Preferably, conveyor 27 and strip cutoff assembly 17 are each driven by a single power source such as a motor 35. Motor 35 is connected through a sprocket arrangement 36, 38, and 40 to drive conveyor 27. In addition to powering conveyor 27, motor 35 serves as a power source for driving strip cutoff assembly 17. A gear box 45 couples motor 35 to a shaft member 47. Shaft member 47 powers the movement of a cutting blade (described hereinafter) at a rate so that the longitudinal vector of movement of the blade exactly equals the movement of conveyor 27.

Figure 5:
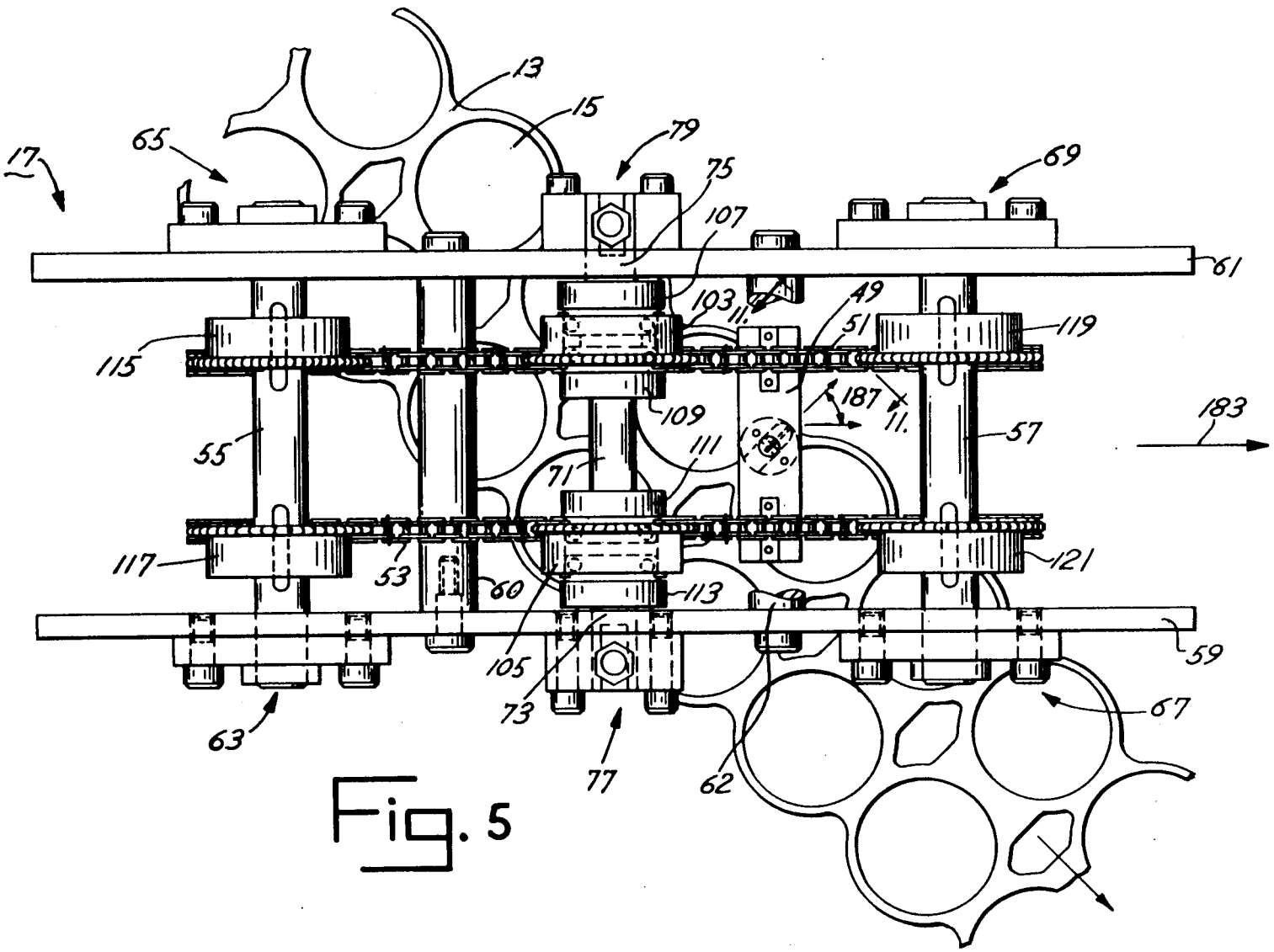
FIG. 5 is a top view of the strip cutoff assembly embodiment of the present invention.
Figure 6:
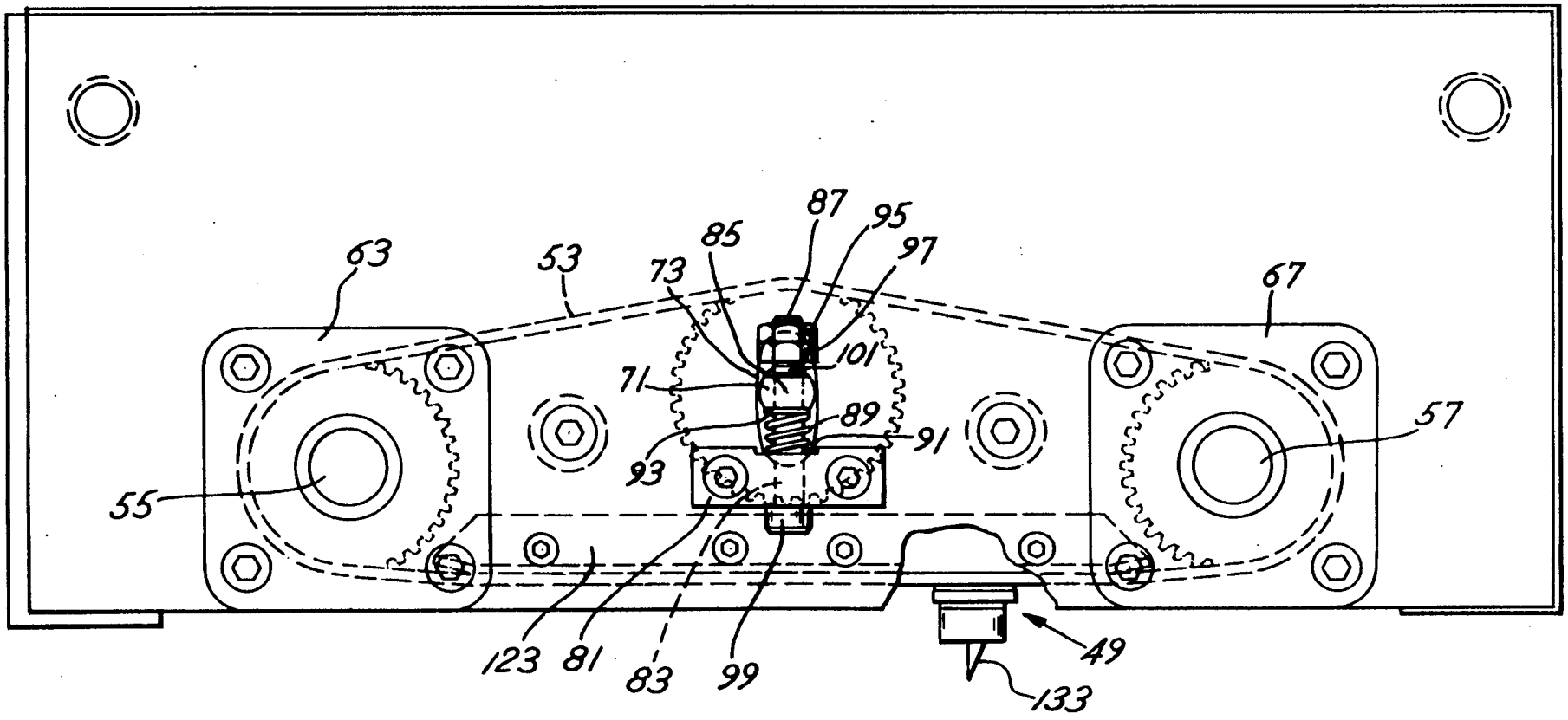
FIG. 6 is a side view of the strip cutoff assembly of FIG. 5.

Referring to FIGS. 5 and 6, strip cutoff assembly 17, includes a blade carriage 49 which is transported by a pair of closed-loop link chains 51, 53. The chains are driven by an axle member 57 which, in cooperation with an axle member 55, serves as a guide for the chains. Blade carriage 49 is transported relative to cans 15, as the cans travel along conveyor 27 (FIG. 4), in order to cut t he plastic strip 13.

Axle members 55, 57 are rotatably mounted between a pair of opposing wall members 59, 61 and are mounted with their axes of rotation parallel to one another. A pair of spacing supports 60,62 interconnect and support wall members 59,61. Axle members 55,57 rotate in bearing assemblies 63, 65 and 67, 69, respectively which are bolted to wall members 59,61. A third axle member 71 is mounted centrally between axle members 55, 57 and, as shown in FIG. 6, is vertically slidable within a pair of mounting slots 73, 75 formed in respective wall members 59, 61. Vertical slot 73 in wall member 59 and vertical slot 75 in opposing wall member 61 are sized to receive axle member 71 and to permit its vertical movement within the slots.

The ends of axle member 71 extend through slots 73, 75 beyond wall members 59, 61. A pair of axle mounts 77, 79 are respectively secured to the outside surface of wall members 59, 61 and slidably engage the extended ends of axle member 71 as the axle member moves within slots 73, 75. Axle mounts 77, 79 serve to retain axle member 71 in slots 73,75 and in parallel relation to axle members 55, 57 as the axle member 71 slides vertically within the slots.

Each axle mount 77, 79 includes a rectangular base portion 81 (FIG. 6) which is bolted to a respective wall member 59, 61 at the lower end of a respective slot 73, 75. A bore 83 extends vertically through each base portion 81 and a bore 85 extends through each end of axle member 71 in alignment with a respective bore 83. A pair of partially threaded bolts 87 extend upwardly through each bore 83,85 permitting axle member 71 to slide along bolts 87 as the axle member moves vertically within slots 73, 75.

A compressed spring 89 surrounds a portion of each bolt 87 between base portion 81 and axle member 71. The lower end of spring 89 sits within a rectangular notch 91 formed in the upper surface of rectangular base portion 81 The upper end of spring 89 sits against a flat surface 93 notched or formed in axle member 71. Spring 89 biases axle member 71 upwardly along bolts 87. As understood, springs 89 vertically position axle member 71 at a location which maintains tension on closed loop chains 51,53.

A pair of nuts 95,97 are threaded onto the upper end of bolts 87 to form a stop end which bounds the upward movement of axle member 71. A bolt head 99 of each bolt 87 forms the other stop end, contacting the bottom side of rectangular base portion 81. When chain 53 is removed for length adjustment, a flat surface 101 formed on the topside of the ends of axle member 71 sits against the lower side of nut 95 thus stopping upward movement of the axle member 71. Thus, axle mounts 77,79 (FIG. 5) slidably position the ends of the axle member 71 to a location related to the length of chains 51, 53. As understood, closed loop chains 51, 53 are equal in length and thus axle mounts 77,79 horizontally align axle member 71.

As shown in FIG. 5, toothed sprocket wheels 103, 105 are mounted onto axle member 71 for rotation relative thereto. A pair of guide blocks 107,109 are secured to axle member 71 on each side of sprocket wheel 103 for maintaining the location of the sprocket wheel as it rotates about the axle member. A similar pair of guide blocks 111,113 maintains the position of sprocket wheel 105.

Each axle member 55,57 carries a pair of toothed sprocket wheels 115,117 and 119,121 for conjoint rotation with the axle members. The three sprocket wheels 115, 103, 119 are aligned along a common plane for carrying closed loop chain 51. Likewise, the three sprocket wheels 117, 105, 121 are aligned along a common plane for carrying closed loop chain 53.

As previously described, motor 35 (FIG. 3) rotatably drives shaft member 47 (FIG. 4). Shaft member 47 is connected to axle member 57 (FIG. 5) causing the attached sprocket wheels 119, 121 to drive chains 51,53 at an equal rate about axle members 55, 57, 71. Blade carriage 49 is mounted onto chains 51,53 so as to be carried orbitally around axle members 55,57,71.

Figure 7:
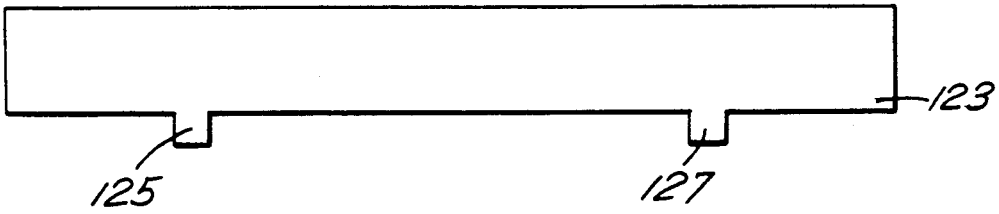
FIG. 7 is a side view of a chain alignment plate of the strip cutoff assembly of FIG. 5.

As shown in FIGS. 6 and 7, a chain alignment plate 123 forms a bottom plate of the strip cutoff assembly and extends between walls 59,61 in the lower portion of the strip cutoff assembly. Chain alignment plate 123 stabilizes chains 51,53 and guides blade carriage 49 as the chains rotate about the axle members. A pair of guide tracks 125,127 (FIG. 7) are formed on and vertically depend from alignment plate 123. Guide tracks 125,127 are tangentially aligned between respective wheel sprockets 117,121 and 115,119 (FIG. 5). Guide tracks 125,127 slidably engage the links of respective chains 53,51 to prevent lateral movement of the chains and blade carriage 49 as the carriage traverses the lower portion of strip cutoff assembly 17.

Figure 8:
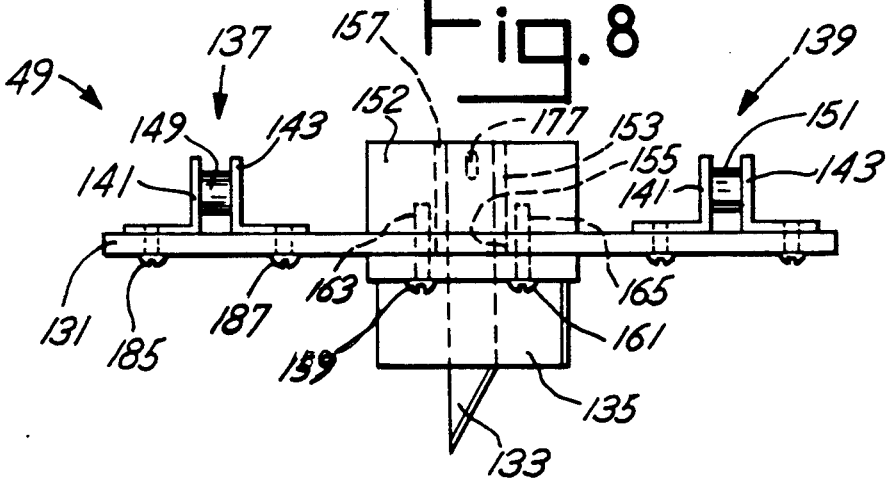
FIG. 8 is a side view of a blade carriage of the strip cutoff assembly of FIG. 5.

Referring to FIG. 8, blade carriage 49 includes a rectangular base plate 131 which carries on its underside a blade 133 and an alignment device 135. Base plate 131 is directly mounted onto chains 51,53 by a pair of chain mounts 137,139 located at each end of the base plate 131. Each chain mount 137,139 includes a pair of L-shaped brackets 141,143 which are securely fastened to the upper side of base plate 131 by a pair of screws 186,188. The L-shaped brackets 141,143 are spacingly aligned back to back for attachment to a pair of chain segments 149,151 which form a portion of chains 51, 53.

In addition, base plate 131 carries on its topside a cylindrical brace member 152 which is fixed at the center of base plate 131. Brace member 152 includes a cylindrical bore 153 which is aligned with a cylindrical bore 155 formed in the center of base plate 131. The two bores receive a bifurcated cylindrical extension 157 of alignment device 135. The bifurcated extension 157 serves to house and secure blade 133 into position.

Alignment device 135 is secured to the bottom side of base plate 131 by screws 159,161 which extend upwardly through base plate 131 and into threaded bores 163,165 located in brace member 152. Thus, brace member 152 provides an area for housing blade 133 and an area for receiving screws 159, 161.

Figure 9:
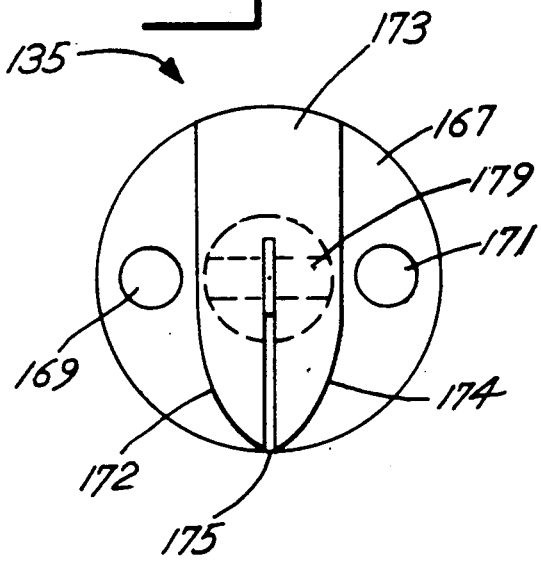
FIGS. 9 and 10 are a bottom view and a cross sectional side view, respectively, of an alignment device of the strip cutoff assembly of FIG. 5.
Figure 10:
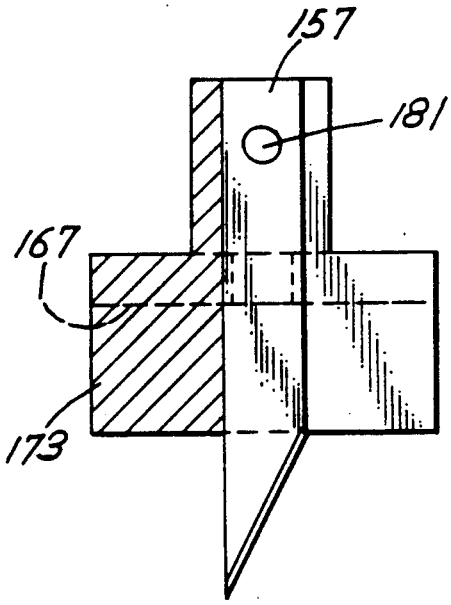

As shown in FIGS. 9 and 10, alignment device 135 includes a circular base portion 167 which is sized for providing an area for receiving a pair of bores 169,171. Bores 169,171 serve to locate screws 159,161 (FIG. 8) for securing the alignment device 135 to base plate 131 of the carriage.

A wedge member 173 depends from base portion 167 and extends across the diameter of base portion 167 and tapers at one end forming curved guide surfaces 172,174. A slot 175 passes through wedge member 173 and base portion 167 and cylindrical extension 157, and is sized for receiving the top portion of blade 133. An aperture 177 (FIG. 8) is formed in the top end of blade 133 for receiving a dowel pin 179 (FIG. 9) which secures blade 133 within slot 175. An aperture 181 (FIG. 10) is formed in cylindrical extension 157 for receiving dowel pin 179 for locating blade 133 relative to wedge member 173. As shown in FIG. 10, blade 133 extends below wedge member 173. The blade is replaceable by movement of the dowel pin.

As shown in FIG. 4, strip cutoff assembly 17 is located at an angle 184 with respect to conveyor 27 such that the blade carriage 49 travels along a path 183 which is disposed at an angle 184 with respect to the path of movement of the containers along path 185. The strip cutoff assembly 17 is positioned above the connected continuum of containers 15 a distance which permits blade 133 to intersect the plastic strip 13 as the blade carriage 49 travels along the lower portion of the strip cutoff assembly.

As the can-type containers 15 travel along conveyor 27, blade carriage 49 orbits axle members 55, 57, 71 periodically traversing the tops of the containers along path 183. As blade carriage 49 moves along path 183, the carriage has a velocity component parallel to the path 185 traveled by cans 15. As previously described, the movement of the strip cutoff assembly 17 and the conveyor 27 are synchronized. Their movement is synchronized such that blade 133 travels with the velocity component, which is parallel to path 185, at a magnitude equal to the magnitude at which the connected continuum of cans progresses along path 185. As blade carriage 49 moves along its path 183, the carriage traverses the continuum between pairs of adjacently ranked cans making a lateral incision in the plastic strip 13.

Figure 11:
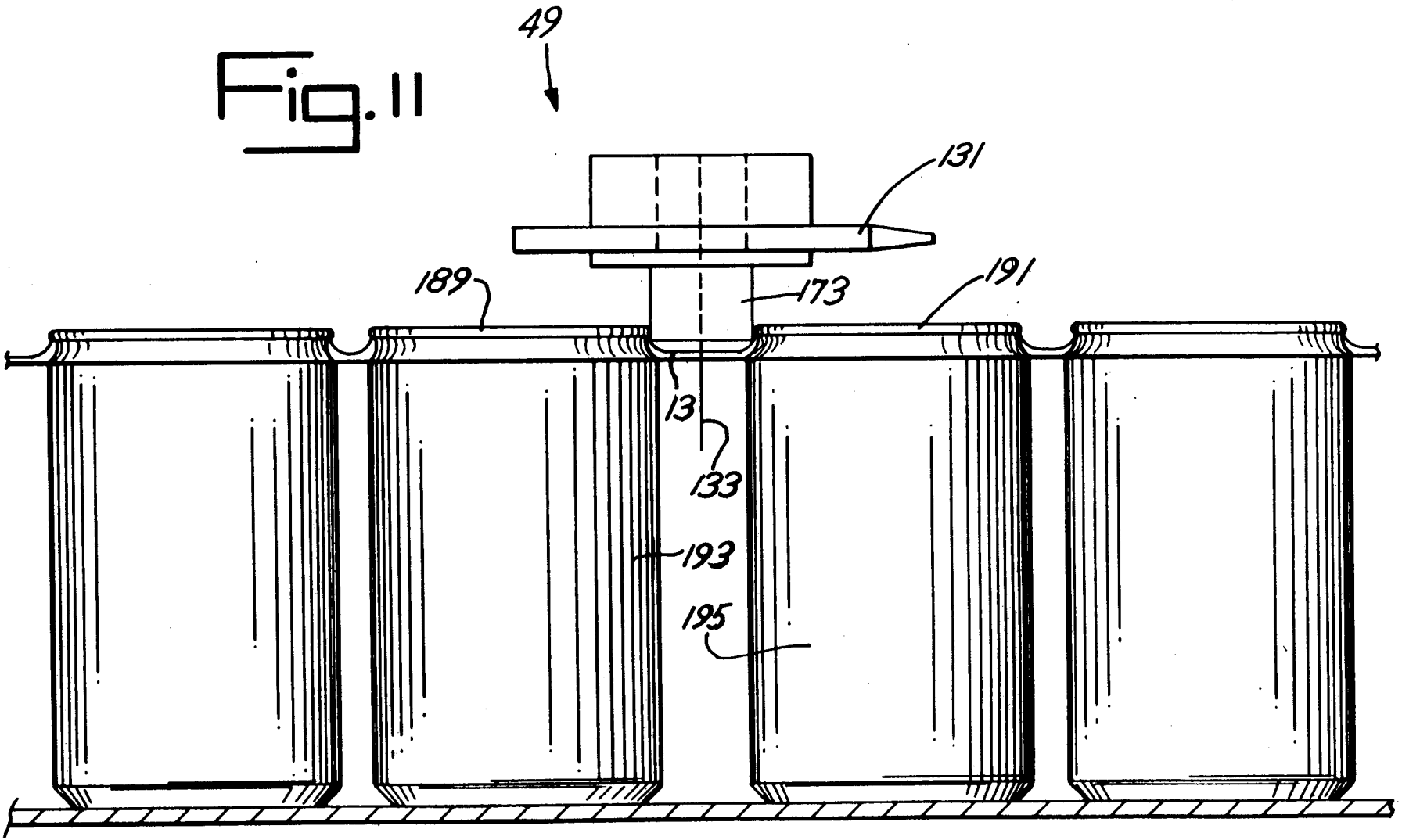
FIG. 11 is a view of the blade carriage of FIG. 8 taken along lines 11—11 of FIG. 5.

FIG. 11 provides a view of blade carriage 49 along lines 11—11 of FIG. 5. Wedge member !73 is mounted on base plate !31 at an angle 187 (FIG. 5) to the direction of movement of the blade carriage along path 183. Thus, wedge member 173 is angled in a direction parallel to the rows of the cans on conveyor 27.

As understood, wedge member 173 passes between adjacent rows of cans. As shown in FIG. 11, wedge member 173 slidably contacts rims 189,191 of adjacent cans 193,195 spacing the cans apart and flexing the plastic strip between cans 193,195 as blade 133 cuts through plastic strip 13.

Incisions made by the blade 133 as it orbits the axle members 55, 57, 71 (FIG. 5) partition the continuous connecting plastic strip 13 as it progresses along conveyor 27 into carrier units of uniform length (number of cans). The length of each carrier unit is determined by the orbital period of blade carriage 49. Thus, the length of the carrier units may be increased or decreased by lengthening or shortening chains 51, 53.

While only a preferred embodiment of the invention has been described hereinabove, those of ordinary skill in the art will recognize that the embodiment may be modified or altered without departing from the central spirit and scope of the invention. Thus, the preferred embodiment described hereinabove is to be considered in all respects as illustrative and not restrictive, the scope of the invention being indicated by the appended claims, rather than by the foregoing description, and all changes which come within the meaning and range of equivalency of the claims are intended to be embraced herein.

What is claimed is:

1. A strip cutoff assembly for use in a can container packaging system for successively partitioning a continuous plastic strip which retains a continuum of can containers as the continuum of can containers moves along a first path at a predetermined rate, the plastic strip encircling an upper portion of each of the can containers which are arranged in an array of multiple rows, said strip cutoff assembly comprising:

a blade carriage;

a planar cutting blade carried by said blade carriage, said cutting blade partitioning said continuum into units;

moving means for successively moving said blade carriage along a second path disposed at a first angle with respect to said first path, said moving means driving said cutting blade with a continuous motion along said second path and including a first axle member and a second axle member being rotatably mounted for rotation about separate axes parallel to one another, and a third axle member rotatably mounted for rotation about an axis separate from and parallel to said axes of said first and second axle members, said moving means including closed loop belt means driven by said first axle member, said blade carriage being secured to said belt means, and said moving means including means for adjustably mounting said third axle member with respect to said first and second axle members to a position for changing the orbit length of said blade carriage for changing the number of containers in the units partitioned by said cutting blade; and alignment means for slidably engaging with said can containers as said blade carriage moves said cutting blade between the rows of containers.

2. A strip cutoff assembly according to claim 1 wherein said closed-loop belt means is formed from a plurality of links, said links being added or removed from said closed-loop belt means for changing the number of cans in the units partitioned by said cutting blade.

* * * * *